United States Patent [19]

Howard

[11] 3,956,913

[45] May 18, 1976

[54] KEY HOLDER

[76] Inventor: Raymond W. Howard, P.O. Box 717, Ketchum, Idaho 83340

[22] Filed: Jan. 27, 1975

[21] Appl. No.: 544,430

[52] U.S. Cl. ..... 70/456 R; 70/459

[51] Int. Cl.[2] ..... A47G 29/10

[58] Field of Search ..... 70/456 R, 459; 24/3 K, 24/201 S, 230.5 S, 230.5 W

[56] References Cited

UNITED STATES PATENTS

| | | | |
|---|---|---|---|
| 1,668,833 | 5/1928 | Thayer | 40/21 |
| 2,846,866 | 8/1958 | Hill | 70/456 R |
| 2,896,290 | 7/1959 | Salm | 70/456 R X |
| 3,367,157 | 2/1968 | Woofter | 70/459 |
| 3,715,900 | 2/1973 | Sherman | 70/456 R |

*Primary Examiner*—Robert L. Wolfe

[57] ABSTRACT

The key holder comprises a substantially flat male disc having projecting, diametrically opposed studs and a female disc having a centrally cut groove in one of its faces, projecting portion of the face having the groove being provided with holes operable to receive the studs when the female and male discs are in proper registry and a key clip being a substantially U-shaped member operable to engage locking means provided on the projecting portions of the sidewalls. The groove is operable to receive the grip portion of a key or the key clip.

5 Claims, 2 Drawing Figures

KEY HOLDER

FIELD OF INVENTION

The present invention relates to key chains, key rings and key holders.

DESCRIPTION OF THE PRIOR ART

It is the object of this invention to disclose a key holder having an improved design which may be converted from the key ring or to a key holder or handle.

It is a further object of this invention to provide the aforesaid key holder with components of simple construction and of simple interconnection.

These and other objects shall become apparent from the description following, it being understood that modifications may be made without affecting the teachings of the invention here set out.

SUMMARY OF THE INVENTION

The key holder comprises a substantially flat male disc having projecting, diametrically opposed studs and a female disc having a centrally cut groove in one of its faces, projecting portion of the face having the groove being provided with holes operable to receive the studs when the female and male discs are in proper registry and a key clip being a substantially U-shaped member operable to engage locking means provided on the projecting portions of the sidewalls. The groove is operable to receive the grip portion of a key or the key clip.

A more thorough and comprehensive understanding may be had from the detailed description of the preferred embodiment when read in connection with the drawings forming a part of this specification.

DETAILED DESCRIPTION OF THE PREFERRED EMBODIMENT

Figure 1:
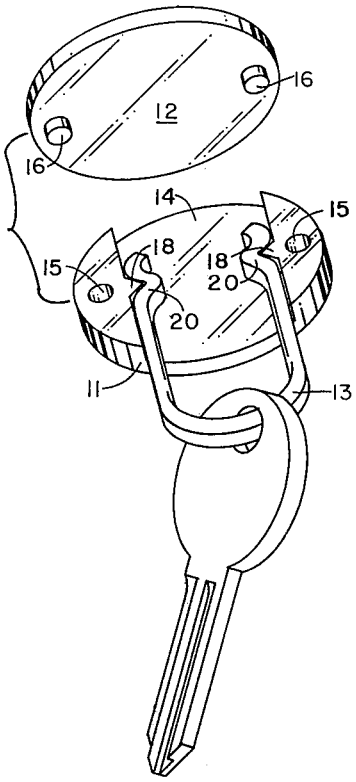
FIG. 1 is a perspective view of the key holder of this invention shown with the top disc thereof exploded away for illustrative purposes.

Referring now to the drawings, and more particularly to the FIG. 1, the key holder of this invention comprises a bottom or female disc 11, a top or male disc 12 and a wire clip 13. The male and female discs have substantially the same exterior configuration here shown as the circle. It, of course, is possible to employ any of a number of configurations, such as polygons, ovals and the like. The female disc 11 is provided on one of its sides with a groove which is cut centrally along a diameter line through the member. A pair of diametrically opposed holes 15 are provided on the projecting portions of the disc 11 on the side having the groove 14.

Figure 2:
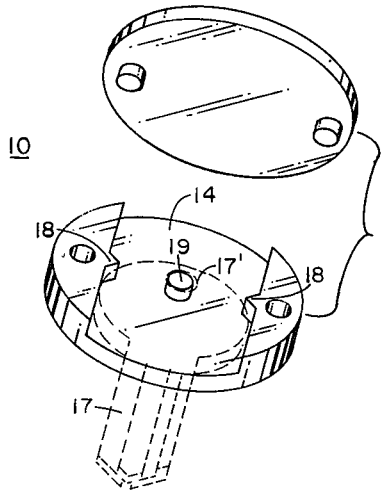
FIG. 2 is a perspective view of a further use of the key holder of the FIG. 1, also shown with the top disc thereof exploded away for illustrative purposes.

The upper or male disc 12 is fabricated with both of its faces substantially flat. One of the faces is provided with a pair of diametrically disposed studs 16 which engage the holes 15 when the discs 11 and 12 are in proper registry. When the groove 14 is of sufficient depth and width to accommodate the clip 13, as shown in the FIG. 1, and a pre-selected size of key 17, as shown in the FIG. 2, it may be seen that the key holder 10 is then intended to be fabricated in a variety of sizes to accommodate various pre-selected sizes of keys. It may also be seen that the groove 14 may also be configured to accommodate keys not having straight-sided grip portions, i.e. keys having projecting ears and the like. Sidewalls of the groove 14 are provided with projecting portions 18 which provide a stop which prescribes the penetration of the grip portion of the key 17, and which provides additional support thereto. A capstan 19 is disposed centrally in the groove at a point suitable to engage the hole 17' to be provided in the grip portion of the grip 17. The capstan 19 provides additional support to the key 17 in the groove 14, and provides further means for aligning even oddly configured keys.

Referring specifically to the FIG. 1, the clip 13 may be used alternatively between the discs 11 and 12 to a key 17. The clip 13 is a substantially U-shaped member which may be provided with a straight leg issuing perpendicularly from a straight base. End portions of the legs of the clip 13 are bent interiorly and then into recesses as each leg progresses to the base. The recesses 20 are suitably configured to closely engage the projecting portions 18 of the groove 14. The clip 13 is of sufficient width so that when the recesses 20 are engaged on the projecting portions 18, the legs of the clip 13 are in contiguous contact with and apply expansive force against the sidewalls of the groove 14. The length of the legs of the clip 13 is sufficient to project the base distally from the circumferential edges of the disc 11 and 12. It may be seen that it is of advantage to provide the projecting portions 18 to one side of the diametrical center line formed by the holes 15 in the female disc so that the teeth of the shaft of the key 17 and the clip 13 project from the mated discs 11 and 12 a predetermined distance. It may be of advantage, at the discretion of the user, to engage the clip 13 at the shorter segment of the groove 14 as defined by the projecting portions 18 to provide the maximum length onto which to engage keys.

Having thus described in detail a preferred apparatus which embodies the concepts and principles of the invention and which accomplishes the various objects, purposes and aims thereof, it is to be appreciated and will be apparent to those skilled in the art that many physical changes could be made in the apparatus without altering the inventive concepts and principles embodied therein. Hence, it is intended that the scope of the invention be limited only to the extent indicated in the appended claims.

I claim:

1. A key holder, comprising:

a male disc and female disc, said discs having substantially the same exterior configuration, said male disc having at least one face being substantially flat, said flat face of said male disc having diametrically opposed studs, said female disc having a groove cut into one of its sides along its diametrical center line of sufficient width and depth to receive the grip portion of a key, said side of said female disc having said groove being provided on its projecting portions with diametrically opposed holes which may frictionally engage said studs when said male disc and said female disc are in proper registry, each of the sidewalls of said groove being provided with an opposing projecting portion; and a detachable mounted key clip, said clip being a U-shaped member having interiorly bent recesses adapted to engage said projecting portions of said groove when said clip is engaged with sidewalls of said groove.

2. The article of claim 1 including a centrally disposed capstan disposed to engage the hole typically provided in said grip portion of said key.

3. The article of claim 1 wherein said projecting portions are disposed to one side of the line formed by said holes of said female discs.

4. The article of claim 1 wherein said U-shaped clip has a substantially flat base.

5. The article of claim 1 wherein said groove is of sufficient width and depth to engage the grip portion of said key when said male disc is engaged with said female disc.

* * * * *